United States Patent [19]

DiPlacido

[11] 4,315,494

[45] Feb. 16, 1982

[54] MASONARY SAW JIG

[76] Inventor: Michele DiPlacido, 141 Taysham Crescent, Toronto, Ontario, Canada

[21] Appl. No.: 142,261

[22] Filed: Apr. 21, 1980

[51] Int. Cl.[3] ..... B28D 7/04

[52] U.S. Cl. ..... 125/35; 83/432; 125/13 R

[58] Field of Search ..... 83/708, 432, 435.1; 125/35, 12, 13 R, 13 SS

[56] References Cited

U.S. PATENT DOCUMENTS

| | | | |
|---|---|---|---|
| 127,728 | 6/1872 | Aitken | 83/432 |
| 1,831,124 | 11/1931 | Koster | 83/435.1 |
| 2,464,117 | 3/1949 | Coates | 125/35 X |
| 3,090,615 | 5/1963 | May | 125/35 X |
| 3,168,893 | 2/1965 | Johnson | 125/35 X |
| 3,463,137 | 8/1969 | Hare | 125/35 |
| 3,815,570 | 6/1974 | Story | 125/35 |

*Primary Examiner*—Harold D. Whitehead

[57] ABSTRACT

The present invention relates to a mitre guide jig adapted for use with a masonary saw. The jig comprises a body portion and an end portion to which the body portion is adjustably secured. The body portion includes a single flat work piece receiving face which is bordered by at least one raised side rail and which moves through a variety of tile cutting positions with adjustment of the body portion.

3 Claims, 6 Drawing Figures

MASONARY SAW JIG

FIELD OF THE INVENTION

The present invention relates to a mitre guide jig for use on a masonary saw.

BACKGROUND OF THE INVENTION

According to known construction, a masonary saw consists of a saw blade rotating about a horizontal axis with a reservoir pan being located beneath the saw blade for retaining a coolant which is continuously pumped from the pan onto the saw blade while the saw blade is in use. A sliding platform mounted on tracks directly within the reservoir is provided for moving a workpiece beneath the circular saw blade. Such a construction is shown in U.S. Pat. No. 3,635,206 issued Jan. 18, 1972 to Harclerode.

Unlike conventional saws, the sliding tray of a masonary saw cannot be permitted to have any angle adjustment relative to the saw blade. This is required because the mounting tracks on which the platform slides are, as described above, located directly in the coolant reservoir which would spill its contents if it were tipped out of the horizontal plane. Therefore, because the platform is not adjustable, a separate mitre guide attachment must be provided on the platform in order to produce mitred cuts in a work piece cut by the saw blade.

Very few efficient safety oriented jigs have been developed for use with a masonary saw as described above, for producing the required mitre cuts. As will be appreciated, masonary saws are very dangerous to work with and there is a great need to develop a safety conscious mitre guide jig that is adapted for use with a masonary saw. The prior art structures include arrangements such as that described in U.S. Pat. No. 3,463,137 issued Aug. 27, 1969 to M. J. Hare showing a jig which is used to hold a work piece principally a brick, at an angle relative to a saw blade for producing a mitre cut in the brick. However the reference structure is not readily useable as an attachment to a sliding platform, but rather includes its own sliding arrangement, in lieu of the platform. This of course, increases costs substantially. Furthermore, the reference structure presents a severe safety hazard because it does not include any support means for supporting the work piece in the direction of travel of the saw blade relative to the work piece. Therefore, the operator must place his or her hands, in the cutting area to prevent shifting of the work piece along the jig. This, of course, can result in severe injury, should the operator not be extremely careful. Any one who has worked with these dangerous circular saws, will appreciate that even the slightest lack of concentration can result in the loss of a finger or a hand.

A further drawback of the reference structure is that it does not include any type of adjustable height support for raising or lowering of the work piece relative to the saw blade. Therefore, it is limited to use only with work pieces of a certain fixed height thereby, substantially reducing the versatility of the structure.

A further important feature in a mitre guide is that it should permit cutting of the work piece from both the right hand side and the left hand side of the saw. Although the jig of U.S. Pat. No. 3,463,137 does include this feature, it requires two separate and distinct supporting surfaces for the right and the left hand cutting of the work piece. This again, makes the reference structure quite complicated and expensive to construct.

The present invention provides an uncomplicated, easy and safe to use, jig for a masonary saw which comprises a body portion having a single work piece receiving flat face and an end portion to which the body portion is adjustably secured to vary the position of the work piece receiving face. The end portion is provided with clamping means to clamp the jig to a masonary saw platform, thereby making the jig readily useable with a masonary saw.

The body portion is adjustable to vary the position of the work piece receiving face from an extreme left hand cutting position to an extreme right hand cutting position such that only the single face is required for cutting from either the right or the left hand side of the saw.

For purposes of safety, the body portion is provided with at least one upstanding end rail bordering the end of the work piece receiving face to prevent sliding of the workpiece on the face while cutting. This eliminates the need for the operator to hold the work piece in the cutting area while it is being cut by the saw blade.

The jig is provided with a support bar which is adjustable in position relative to the work piece receiving face and extends across the face at essentially right angles to the end rail, and means for locating the support bar at a plurality of different supporting positions on the tile receiving face. According to a preferred and simple construction, the body portion is notched at intervals to receive the support bar at the different positions. Other mechanical means can also be used to move the bar to different positions so that the support bar provides a height adjustment on the work piece receiving face to expose the desired amount of work piece to the saw blade.

BRIEF DISCUSSION OF THE DRAWINGS

The above as well as other advantages and features of the present invention will be described in greater detail, according to the preferred embodiments of the present invention wherein;

FIG. 1 is a perspective view looking down on a preferred arrangement of a mitre guide jig according to the present invention when secured to a sliding platform of a known masonary saw.

FIG. 1*a* shows the work piece before cutting and

FIG. 1*b* shows the work piece after cutting.

Figure 1:
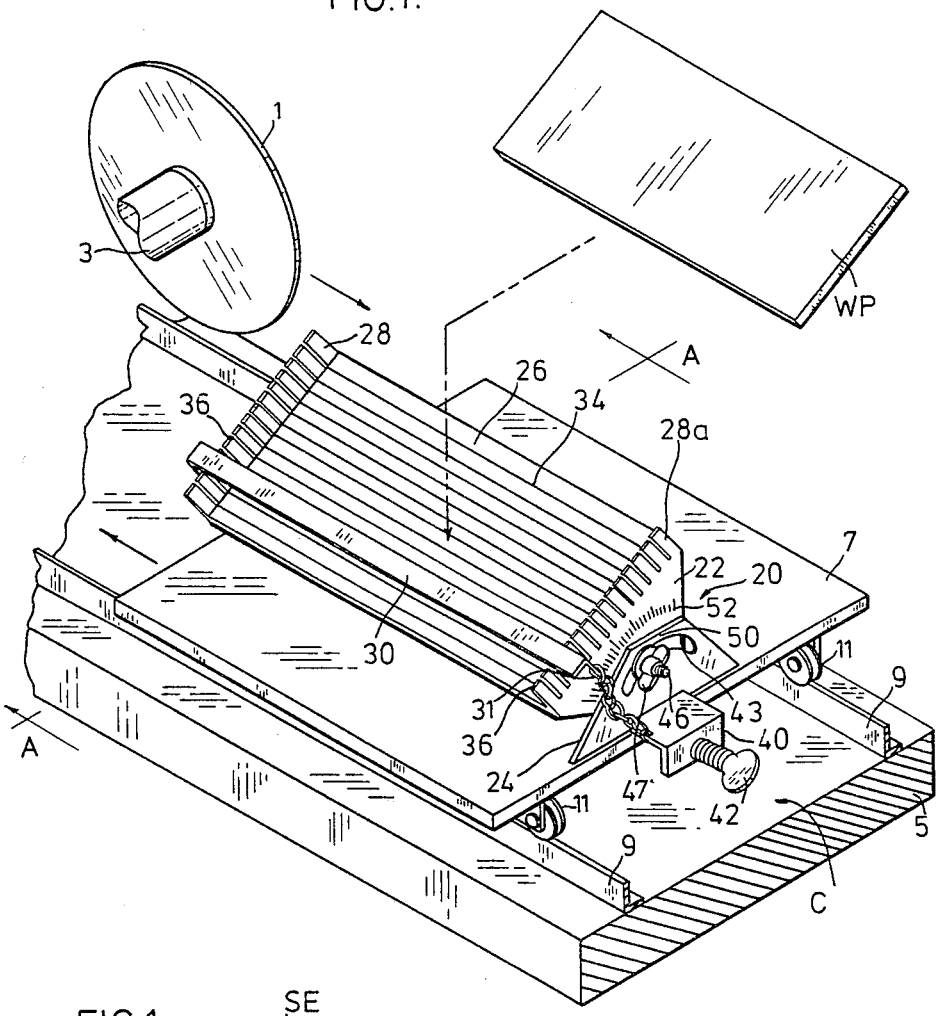

DETAILED DESCRIPTION ACCORDING TO THE PREFERRED EMBODIMENTS OF THE PRESENT INVENTION

A known masonary saw as described in U.S. Pat. No. 3,635,206 includes a saw blade 1 rotatable about a horizontal axis 3, a coolant containing reservoir 5 containing coolant C and a sliding platform 7. The mounts 9 over which the platform wheels 11 travel, are mounted directly in reservoir 5. Therefore, the platform cannot be angled relative to the saw blade because it is secured in the reservoir which must be maintained horizontal to prevent spilling of the coolant. Accordingly, this set up will not permit miter cutting of a work piece located directly on the platform.

A mitre guide jig generally indicated at 20 in FIG. 1 having a preferred construction according to the present invention comprises a body portion 22 and an end portion 24. The end portion is provided with clamping means consisting of clamp 40 and threaded turnscrew 42 for securing the jig to platform 7.

Body portion 22 is provided with a flat work piece receiving face 26 for receiving a work piece generally indicated at WP. In this instance, the work piece is a thin tile which is particularly suitable for use with the jig. Flat face 26 is bordered at each end by upstanding rails 28 and 28*a*. The upstanding rails are provided with a plurality of notches 36 and 36*a* while the work piece receiving face 26 is provided with a plurality of notches 34 in alignment with notches 36 and 26*a*. These notches are spaced at intervals over the flat receiving face to receive a support bar 30 extending across the face at essentially right angles to the raised rails. This support bar locks in position in the aligned grooves or notches in the rails and the flat face and as will be appreciated from the drawings, one can expose the desired amount of tile to the saw blade by simply placing the adjustable support bar in the appropriate sets of grooves.

The support bar may be secured to the jig by means of a chain 31 or any other suitable connection which permits its easy adjustment on the body and which at the same time, maintains the support bar where it is readily accessible.

Other means for raising and lowering the support bar can be used instead of the simple and uncomplicated arrangement described above. For example, the support bar can be rotatably secured to a rotatable threaded shaft which when rotated raises and lowers the shaft to a desired height.

The end portion which is fixed relative to the saw platform is provided with a curved groove 43 for receiving bolt 46 extending from the body portion. Wing nut 47 is threadably engaged on bolt 46 and by releasing and tightening the wing nut on the bolt, the body portion can be adjusted to any angle relative to the saw blade between an extreme left hand cutting position and an extreme right hand cutting position as shown in FIG. 5 the end portion is provided with a marker 50 while the adjustable body portion is provided with a scale 52. This permits easy setting for essentially any angle mitre cut to the work piece as well as cutting from either side of the saw, depending upon how the operator feels most comfortable and what type of cut is required.

As an added feature for preventing any contact between the saw blade and the jig, the body portion is given a triangular shape whereby it cannot be moved to a position in which the flat face is straight up and down. Accordingly, the workpiece is always held at an angle to the vertical, so that as long as there is any overhang of the workpiece beyond the flat face, that overhang is clear of the jig such that it can be cut by the saw blade without any interference from the jig itself.

Figure 2:
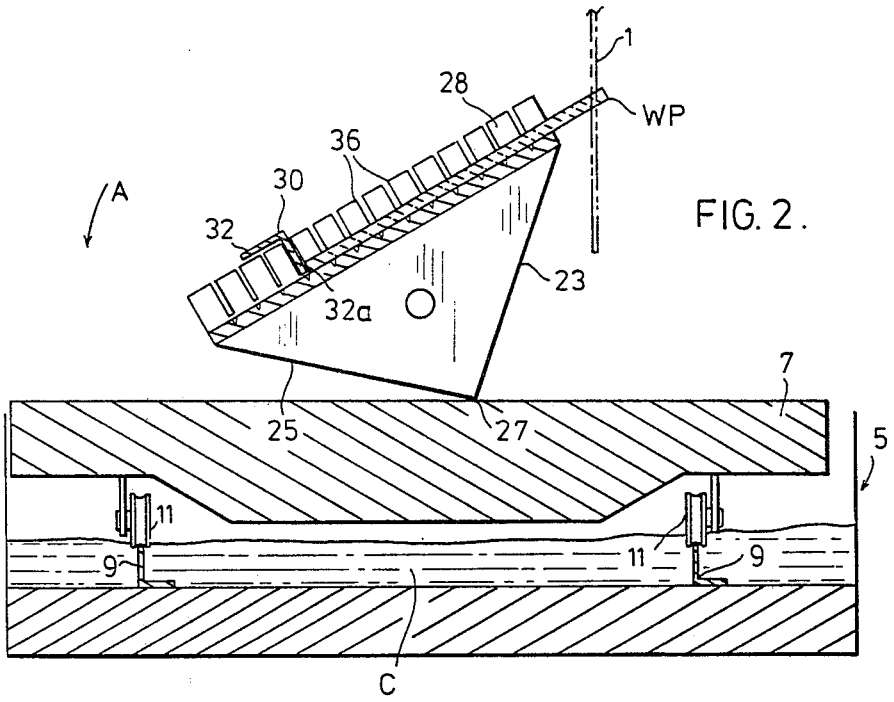
FIG. 2 is a section taken along the lines A—A of FIG. 1 showing the mitre guide positioned for cutting a work piece from the left hand side of the saw.
Figure 3:
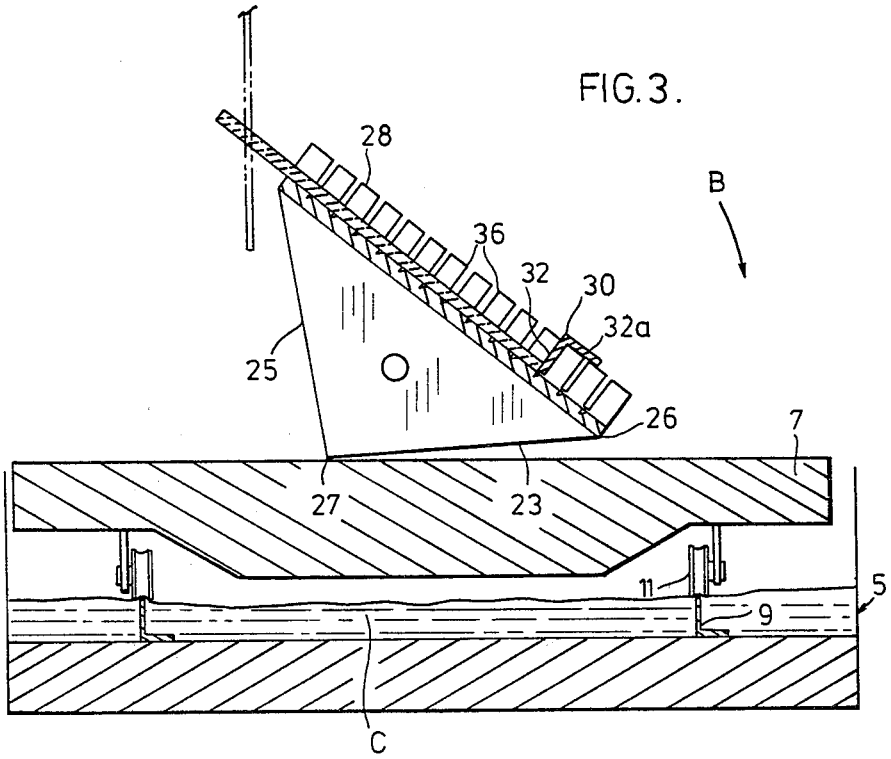
FIG. 3 is a section similar to FIG. 2 with the exception that it shows the mitre guide adjusted for cutting from the right hand side of the saw.
Figure 4:
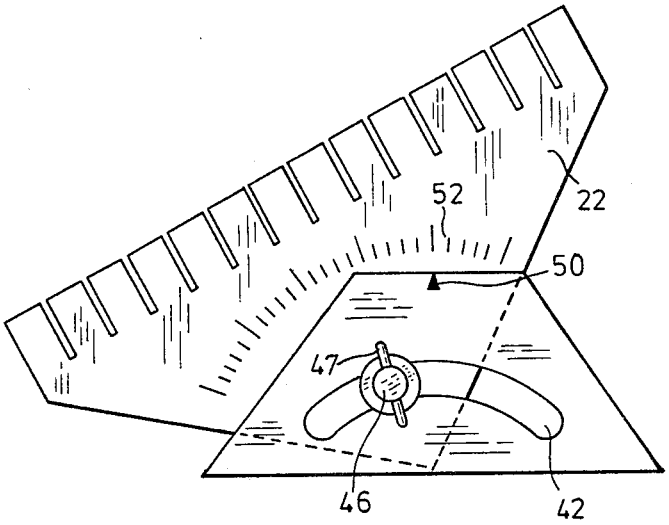
FIG. 4 is an enlarged view of the jig of FIG. 1.

More particularly, the body portion is in the form of an isosceles triangle, as best seen in FIGS. 2 and 3 and includes a pair of equal sides 23 and 25 with the hypotenuse of the triangle being formed by flat face 26. The sides 23 and 25 converge at an apex 27. The apex remains on the platform 7 regardless of the position of the body portion to provide support for the jig. When the body portion is positioned somewhere between the extreme right hand cutting position and the extreme left hand cutting position, both of the sides 23 and 25 are out of contact with the platform. However, when the body portion is moved in the direction of arrow A, in FIG. 3, to the extreme left hand cutting position, in which the saw blade cuts the work piece at a very sharp angle, side 25 rests on platform 7 and provides an adjustment stop preventing the body portion from being moved beyond the extreme left hand cutting position where it would assume a 90° angle to the saw platform. In the case of the extreme right hand cutting position, the body portion is moved in the direction of arrow B until side 23 rests on platform 27 and again, provides an adjustment step.

For purposes of making the support bar reversible to accommodate both the right hand and the left hand cutting positions, while being connected to the jig by chain 31, the support bar has been provided with a pair of essentially identical arms 32 and 32A secured at right angles to one another. As will be seen in FIGS. 2 and 3, when the jig is in the left hand cutting position, arm 32A is fitted in the aligned notches on the face portion and the raised side rails and presents a base support for the work piece while arm 32 sits on the upper edges of the rails to provide additional support to the support bar. When the jig is moved to the right hand cutting position, arm 32 is fitted in the grooves and presents a supporting base for the work piece while arm 32A extends parallel to the receiving face over the raised side rails to additionally support the bar.

Figure 1A:
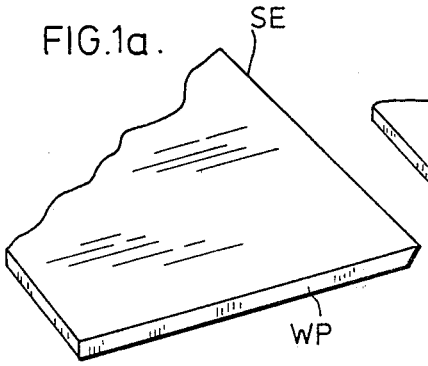
Figure 1B:
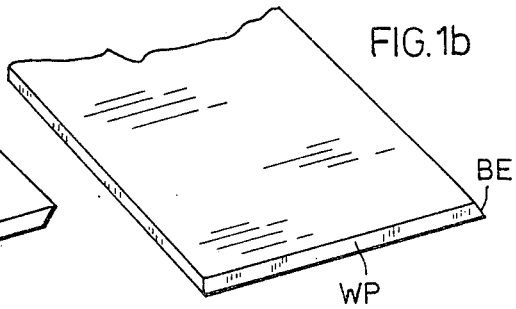

As mentioned above, the jig is particularly suitable for use with a work piece such as a tile for bevelling a square edge SE, as shown in FIG. 1A to provide bevelled edge BE in FIG. 1B. The tile is placed on flat face 26 with bar 30 adjusted to expose the desired amount of tile to the saw blade. The tile is then moved beneath the saw blade by pushing on platform 7, keeping the hands completely free of the work area. The tile, even though it is light in weight and would normally slide, is supported against sliding under pressure of the saw blade in the first pass, by raised rail 28*a*, which again, eliminates any need for the hands of the operator to be in the cutting area to hold the tile in place. In the event that the cut is not completed on the first pass beneath the saw blade, and a back and forth cutting motion is required, both side rails come into play for preventing sliding of the tile in either direction, relative to the saw blade. The jig of course, can be used with other suitable work pieces that would be cut on a masonary saw, such as bricks, stones, etc.

The drawings show the use of a pair of raised rails. However, one of these rails, i.e., the front rail 28, can be eliminated, for receiving longer work pieces than the tile shown in the drawings. Rail 28*a* would still provide the required longitudinal support for preventing sliding of the work piece in a single pass beneath the saw blade and would eliminate the need for the operator to place his or her hands beneath the saw blade.

It will now be seen that although the jig of the present invention is easy to use and inexpensive to construct, it is extremely efficient in its operation. Furthermore, only certain preferred embodiments of the invention have been described herein in detail and it will be appreciated by one skilled in the art that variations may be made thereto, without departing from the spirit of the invention or the scope of the appended claims.

The embodiment of the invention in which an exclusive property or privelege is claimed are defined as follows:

1. A portable mitre guide jig for use with a masonary saw, said mitre guide jig comprising a triangular body portion having a work piece receiving face and a pair of symmetrical side faces converging to an apex, and an end portion to which said body portion is adjustably secured to adjust said work piece receiving face about said apex from a right hand cutting position to a left hand cutting position to enable cutting from either side of the saw, said end portion being provided with clamping means to removably clamp said mitre guide jig to a masonary saw platform, said work piece receiving face being flat and being bordered by at least one end rail which is raised relative to said work piece receiving face for preventing horizontal movement of a work piece placed thereon against said at least one side rail, an adjustable support bar for supporting the work piece on said work piece receiving face and means for locating said support bar at a plurality of different supporting positions on said work piece receiving face, said side faces providing an adjustment stop to prevent over adjustment of said work piece receiving face with respect to the saw and said body portion being provided with a plurality of spaced notches for receiving said support bar at said plurality of different supporting positions in said notches.

2. A mitre guide jig as claimed in claim 1, including two end rails, one at each end of said work piece receiving face, wherein both of said end rails and said work piece receiving face are notched to receive said support bar at different positions.

3. A mitre guide jig as claimed in claim 1, or 2 wherein said support bar consists of a pair of essentially identical straight arm portions secured at 90° to one another, whereby said support bar is reversible on said work piece receiving face to accommodate both said right hand cutting position and said left hand cutting position.

* * * * *